US005348242A

United States Patent [19]

Bauer et al.

[11] Patent Number: 5,348,242

[45] Date of Patent: Sep. 20, 1994

[54] YARN WINDING APPARATUS WITH YARN CUTTING CAPABILITY

[75] Inventors: Karl Bauer; Peter Dammann; Friedrich Urbahn, all of Remscheid, Fed. Rep. of Germany

[73] Assignee: Barmag AG, Remscheid, Fed. Rep. of Germany

[21] Appl. No.: 46,014

[22] Filed: Apr. 12, 1993

[30] Foreign Application Priority Data

Apr. 11, 1992 [DE] Fed. Rep. of Germany ..... 4212241

[51] Int. Cl.[5] ..... B65H 54/02; B65H 54/71

[52] U.S. Cl. ..... 242/18 EW; 242/19

[58] Field of Search ..... 242/18 EW, 18 PW, 19, 242/35.5 A, 18 A

[56] References Cited

U.S. PATENT DOCUMENTS 4,720,702 1/1988 Martens ..... 340/677
4,948,057 8/1990 Greis ..... 242/18 R
5,107,668 4/1992 Dammann ..... 242/35.5 A X
5,158,241 10/1992 Dammann et al. ..... 242/18 PW

*Primary Examiner*—Stanley N. Gilreath
*Attorney, Agent, or Firm*—Bell, Seltzer, Park & Gibson

[57] ABSTRACT

A yarn winding apparatus for winding a cross wound package, and comprising a cutting blade arranged below the traversing triangle and a yarn lifting member which is adapted for movement between positions below and above the traversing triangle. When the winding of a package is completed, the lifting member is lifted, which in turn lifts the advancing yarn from its traversing triangle, and in addition, the lifting member captures and retains the advancing yarn in a laterally fixed position. Upon the subsequent lowering of the lifting member, the captured yarn is brought into the engagement with the cutting blade and severed. In the lifted position of the lifting member, the advancing yarn also may be lifted from its reciprocating yarn guide so that a plurality of circumferential final winds are formed on the completed package.

14 Claims, 3 Drawing Sheets

YARN WINDING APPARATUS WITH YARN CUTTING CAPABILITY

BACKGROUND OF THE INVENTION

The present invention relates to a yarn winding apparatus wherein the advancing yarn is traversed along a rotating bobbin so as to form a cross-wound package, and which incorporates a cutting device which is adapted to sever the advancing yarn at the end of the winding of the package.

EP 0 403 949 A1 discloses a yarn winding apparatus of the described type, and which has proven itself for severing yarns advancing at any desired speed and without incurring the risk of spreading of the severed yarn ends. The disclosed apparatus has the special advantage that it performs the cutting operation substantially independently of the yarn tension, and specifically independently of peaks in the yarn tension. However, the disclosed apparatus does not easily permit the formation of a final wind consisting of several yarn windings on the package at the completion of the winding cycle.

It is accordingly an object of the present invention to provide a yarn winding apparatus having provision for severing the yarn at the completion of the winding cycle, which provides the above noted advantage of the apparatus disclosed in EP 0 403 949 A1, and which further offers the possibility of selectively forming a final wind consisting of several substantially parallel yarn windings on the package at the completion of the winding cycle.

SUMMARY OF THE INVENTION

The above and other objects and advantages of the present invention are achieved in the embodiment described herein, by the provision of a yarn winding apparatus which comprises means for rotatably mounting a tubular yarn bobbin for rotation about a laterally directed rotational axis, drive means for rotating the bobbin about the rotational axis, and means for advancing a yarn to the bobbin so as to be wound thereupon. The yarn advancing means includes a yarn traverse guide, means for laterally reciprocating the yarn traverse guide and so as to form a cross wound package, and a fixed yarn guide mounted upstream of the reciprocating yarn traverse guide so that the advancing yarn defines a traversing triangle and a traversing plane. A yarn cutting blade is mounted on one side of the traversing plane, and yarn lifting and catching means is provided for selectively lifting the advancing yarn from the traversing plane in a direction away from the yarn cutting blade, then capturing and retaining the lifted advancing yarn in a laterally fixed position which is aligned with the yarn cutting blade when viewed in a direction perpendicular to said traversing plane, and then moving the advancing yarn in a direction opposite the lifting direction and into contact with the yarn cutting blade so as to sever the advancing yarn.

In the preferred embodiment, the yarn lifting and catching means comprises a laterally directed slide rod which extends generally parallel to the rotational axis of the bobbin, and which includes two laterally directed arms which are inclined with respect to each other so as to have the configuration of a shallow V. A yarn catch is joined between the arms at a medial portion along the length of the slide rod. An actuation member is also provided for selectively moving the slide rod between an idle position below the traversing plane and a lifted position above the traversing plane.

Also in the preferred embodiment, the traversing yarn guide includes an upwardly open yarn receiving slot, and such that the yarn is lifted from the slot so as to separate the yarn from the reciprocating yarn traverse guide when the slide rod is moved to its lifted position.

A significant advantage of the present invention is the fact that the slide rod, once it has raised the yarn above the traversing plane and so as to be separated from the yarn traverse guide, remains in its lifted position during a time interval which is determined by a desired number of final yarn windings which are to be formed on the finished package, and before it returns to its lower position where it brings the advancing yarn into engagement with the cutting blade. As an alternative, after the slide rod has been raised to withdraw the yarn from the yarn traverse guide, it may be immediately returned to its lower position, in which event no final windings are formed.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
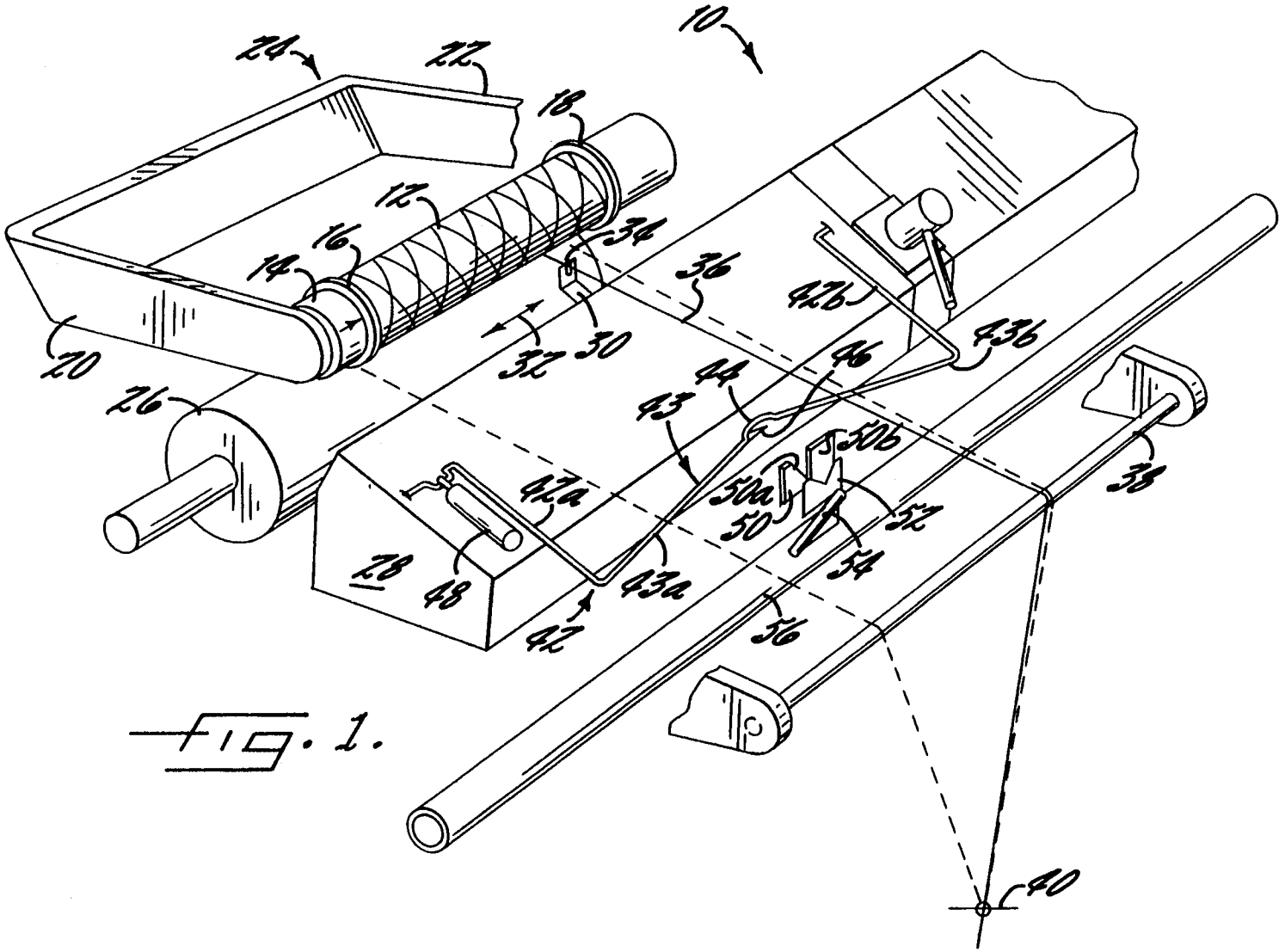
FIG. 1 is a perspective view of a yarn winding apparatus which embodies the present invention, with the yarn lifting member in its idle position below the traversing plane.
Figure 2:
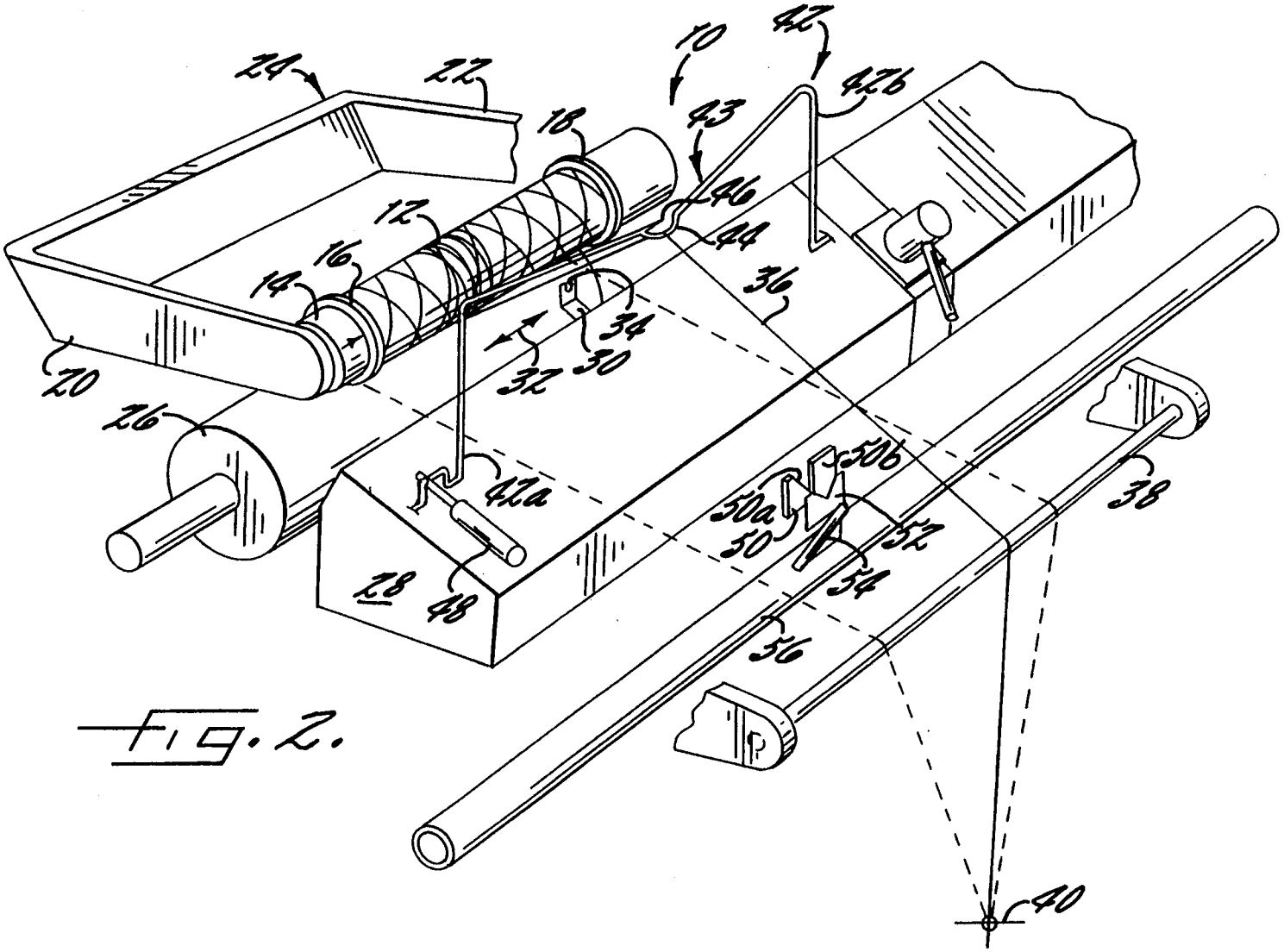
FIG. 2 is a view similar to FIG. 1 but illustrating the yarn lifting member in its lifted position above the traversing plane.
Figures 3, 4:
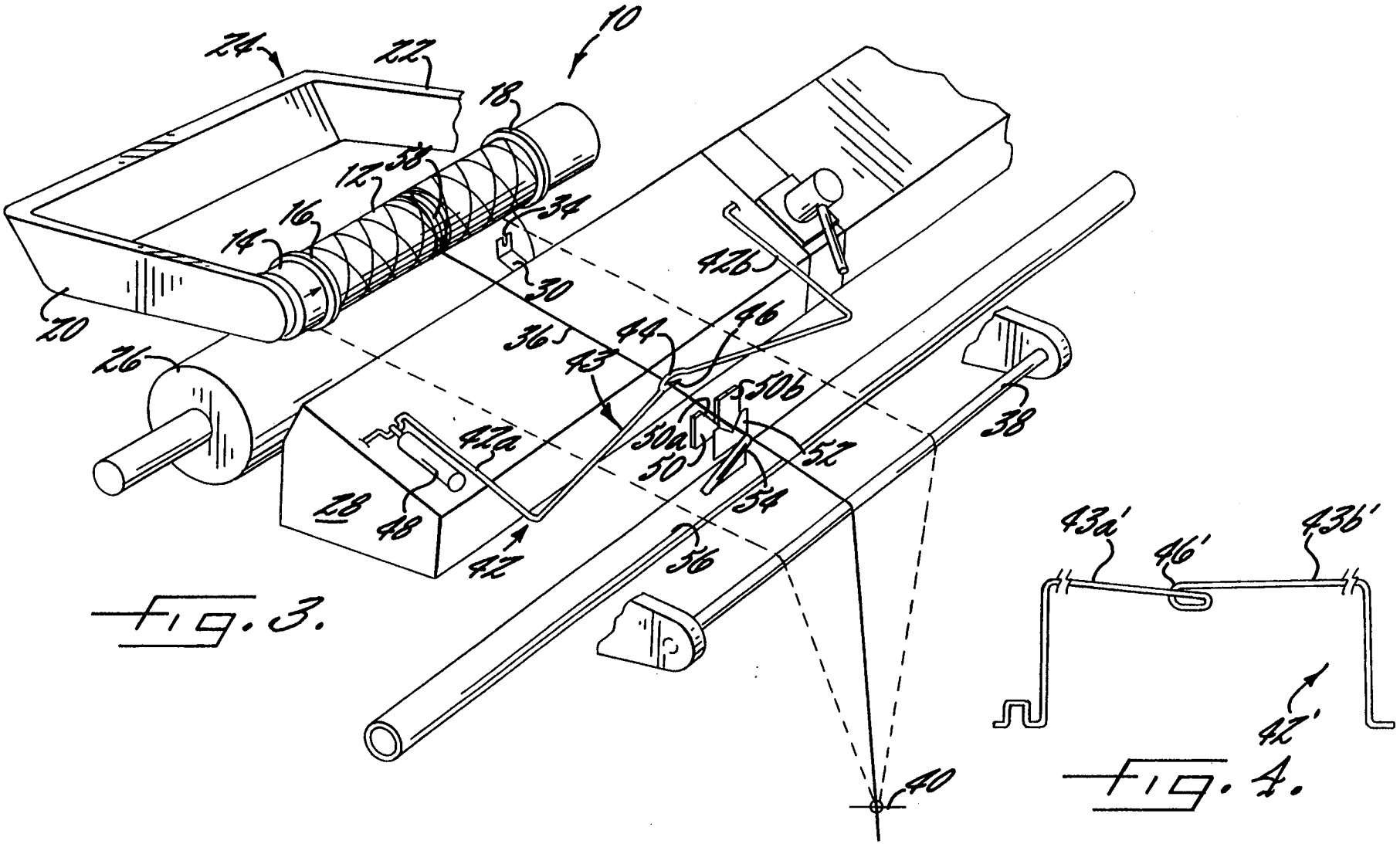
FIG. 3 is a view similar to FIG. 1 but illustrating the yarn lifting member after having been raised so as to capture the yarn, and then lowered to bring the yarn into engagement with the cutting blade.
FIG. 4 is a fragmentary view of a modified embodiment of the yarn lifting member.

Referring more particularly to the drawings, FIGS. 1–3 illustrate one preferred embodiment of a yarn winding apparatus in accordance with the present invention. As illustrated, the apparatus comprises a tubular yarn bobbin 14 having a yarn wound thereupon to form a cross-wound package 12. The bobbin 14 is rotatably supported between centering plates 16 and 18 on the opposite arms 20 and 22 of a conventional mounting bracket 24, which forms a part of the textile machine, which is not further shown. The bobbin 14, or the cross wound package 12 formed thereon, rests on a friction drive roll 26. The roll 26 is rotated by a conventional drive (not shown) and thereby rotates the bobbin 14 and the package 12 being formed thereon.

Located in front of the friction drive roll 26 is a housing 28 which is provided with a slot, which is not visible in the drawing. From this slot a traverse yarn traverse guide 30 projects. The yarn traverse guide 30 is reciprocated by a cross-spiralled roll located in the housing 28, but not shown, along a lateral direction which is parallel to the rotational axis of the bobbin 14, as is indicated by a double arrow 32. The yarn traverse guide 30 is provided with an upwardly open slot 34, which serves to guide an advancing yarn 36 which is pulled by the package 12 under a certain tension over a yarn guide rod 38 and through a preceding, fixed yarn guide 40, such as an eyelet. As a result of the reciprocating motion of the yarn traverse guide 30, the yarn 36 defines a traversing triangle, which in the drawing is shown bent over the yarn guide rod 38. The lateral extension of the triangle is shown by dash-dotted lines. The surface covered between the yarn traverse guide 30 and the yarn guide rod 38 may also be described as a traversing plane.

In the direction of the advancing yarn, and preceding the yarn traverse guide 30, a yarn lifting member 42 is positioned, which is in the drawing shown as a U-shaped bracket, whose legs 42*a* and 42*b* are parallel to each other and pivotally supported at their inner ends on the housing 28 so as to pivot about a lateral axis which is parallel to the rotational axis of the bobbin 14 and package 12. At their outer ends, the legs 42*a* and 42*b* are interconnected to a laterally directed slide rod 43 which extends between the outer ends of the legs 42*a* and 42*b*. The slide rod 43 comprises two laterally directed arms 43*a* and 43*b* which are inclined with respect to each other so as to have the configuration of the shallow V. A yarn catch 44 is joined between the adjacent ends of the arms 43*a* and 43*b*, and so as to be located at a medial location along the length of the slide rod.

In the embodiment of FIGS. 1–3, the yarn catch 44 is in the form of all U having two laterally spaced ends, and with the ends being joined to respective ones of the arms 43*a* and 43*b*. The U is directed downward when the bracket 42 is lifted, as further described below. The yarn catch 44 further includes an extension or yarn retainer 46 which projects from arm 43*a* and is directed toward arm 43*b*, and extends across the open end of the U. The extension 46 is dimensioned such that it extends with its tip above the U, and its tip forms with respect to the other arm 43*b* a laterally open gap. The extension 46 has the same inclination as the arm 43*a*, from which it projects continuously, i.e., with a smooth transition.

One leg 42*a* of the bracket 42 is connected with a schematically illustrated actuator 48, which comprises for example, an electromagnet or a double-acting piston-cylinder unit. This actuator causes the bracket 42 to pivot between its lowered idle position shown in FIG. 1 and a lifted position which is shown in FIG. 2, which constitutes a rotational distance of about 90°. It is important that the bracket 42 lies in its idle position below the yarn 36, i.e., below the traversing plane, and that its arms 43*a* and 43*b* extend on both sides beyond the traversing triangle.

Another embodiment of the yarn lifting member is shown in FIG. 4 at $42^1$. This embodiment differs in its shape from the previously described embodiment, in that it is not provided with an extension 66 projecting from one of the two arms and extending partially over the U of the yarn catch. Instead, the arms $43a^1$, $43b^1$ which are also here inclined toward one another in shallow V-shape, are interconnected by a helical loop $46^1$, the latter being open when viewed in direction of the bite of the shallow V formed by the arms. Thus, when the lifting member $42^1$ is raised, the yarn sliding along one of the arms can enter into the loop $46^1$, but the yarn is unable to escape from the loop during a downward movement of the lifting member, and it can thus be guided into contact with the cutter so as to be severed. In other respects, the yarn is handled by the lifting member $42^1$ of FIG. 4 in the same manner as by the previously described lifting member 42.

Other embodiments of the yarn lifting member are possible. For example, the member may be telescopically movable between positions below and above the traversing plane. In this case, its upper edge or slide rod would be made V-shaped, and its bite portion would be provided with a yarn catch of a construction substantially as described above.

Arranged in the direction of the advancing yarn and upstream of the lifting member 42 is a cutter 50, which has an obliquely upwardly directed cutting blade 50*a*, which faces a likewise obliquely upward directed guide edge 50*b*. The cutting blade 50*a* and the guide edge 50*b* form between them an upwardly open V-shaped slot. The opening of the slot lies below the traversing plane. Located in front of the cutter 50 and the guide edge 50*b* is a yarn centering device 52 whose upper edge is also in the form of a V-shape slot.

Located in front of the yarn centering device 52 is a suction device 54 in the form of a small tube, which is connected to a source of vacuum (not shown), and one end of which opens approximately at the same level as the bite of the V-shaped slots of the cutter and yarn centering device. The tube 54 leads into a collection pipe 56 which extends parallel to the yarn guide rod 38 and leads to the source of vacuum and a waste receptacle (not shown).

The bite of the slot of the centering device 52, the bite formed by the arms 43*a* and 43*b* of the slide rod 43, and the stationary yarn guide 40, extend in a common vertical plane. The opening of the suction tube 54 lies closely adjacent to this plane and at the same height as the bites of the cutting and centering slots. The cutting blade 50*a* of cutter 50 intersects the plane at an acute angle, i.e., the blade 50*a* is aligned in the direction of the movement of the yarn 36 leading toward the cutter 50 for cutting such that the yarn 36 has essentially no relative component of movement transversely to the cutting blade 50*a*. Otherwise, the cutter 50 extends at a right angle relative to the vertical plane which intersects the bite of the arms 43*a*, 43*b*, the bite of the centering slot 52, and the stationary yarn guide 40.

In operation, the yarn advancing through the stationary yarn guide 40 and the upwardly open slot 34 of yarn traverse guide 30, is wound due to the reciprocal motion of yarn traverse guide 30 into a cross wound package 12 on the rotating bobbin 14. In so doing, the yarn advances above the yarn lifting member 42, cutter 50, and centering device 52, and forms a traversing triangle, which is bent over the yarn guide rod 38. As soon as the package 12 reaches a predetermined diameter, a device (not shown) releases a signal indicating the end of the winding cycle. This signal is transmitted to the activator 48 of the lifting member 42. The signal triggers a motion of the actuator 48 in the sense of pivoting the lifting member 42 to its upright lifted position shown in FIG. 2. In so doing, it lifts the yarn 36 out of the upwardly open slot 34 of yarn traverse guide 30. Due to its tension and the inclination of arms 43*a* and 43*b* of the slide rod of the lifting member 42, the yarn 36 slides along the underlying arm 43*a* or 43*b*, and if need be, along the extension 46, and through the gap into the yarn catch 44. In so doing, it slides below the extension 46 or respectively into the loop $46^1$ (FIG. 4). However, since the package 12 continues to rotate, the yarn 36 is guided to a point on the circumference of package, which lies substantially in the same vertical plane as the catch 44, centering device 52, and stationary yarn guide 40. Thus, the package 12 receives a final wind 58 consisting of several yarn windings. Upon expiration of a time interval corresponding to the number of desired yarn windings, the actuator 48 is reactivated, this time in the sense of returning the lifting member 42 to its position below the traversing triangle. The formation of the final wind 58 is advantageous, in that it is easy to locate the yarn end, and in addition, it represents an indication of a normally completed winding cycle.

During the downward pivotal movement of the lifting member 42, the yarn 36 is held by extension 46 or respectively loop 46[1], and guided against cutting blade 50*a*, and severed, i.e., the yarn 36 is guided substantially in the aforesaid vertical plane. At the same time as the yarn 36 is cut, its end advancing from stationary yarn guide 40 is grasped by the suction device 54, and advanced to the waste receptacle. The other end of yarn 36 is taken up in the final wind 58. Subsequently, the completed package 12 can be removed from the mounting bracket 24 by releasing the centering plates 16 and 18 in known manner, and the completed package is replaced with an empty bobbin 14.

As initially indicated, the apparatus of the present invention is also suitable to produce yarn packages without a final wind, as may be desired under certain conditions. To this end, it is necessary to raise lifting member 42 only so much that the yarn 36 engages in the catch 44 on the member 42, and as the latter is pivoted back to its lower position, the caught yarn is guided into cutter 50 and severed. In this instance, the yarn traverse guide 30 may advantageously be constructed such that the yarn 36 remains therein and continues to traverse, until the yarn is guided by lowering the member 42 into cutter 50, and severed, and the short end remaining in the traversing triangle is wound, while its other end is advanced to the waste receptacle.

In the drawings and specifications, there has been set forth a preferred embodiment of the invention, and although specific terms are employed, they are used in a generic and descriptive sense only and not for purposes of limitation.

That which is claimed:

1. A yarn winding apparatus, comprising means for rotatably mounting a tubular yarn bobbin for rotation about a laterally directed rotational axis, drive means for rotating said bobbin about said rotational axis, means for advancing a yarn to the bobbin so as to be wound thereupon and including a yarn traverse guide, means for laterally reciprocating said yarn traverse guide and so as to form a cross wound package, and a fixed yarn guide mounted upstream of said reciprocating yarn traverse guide so that the advancing yarn defines a traversing plane, a yarn cutting blade mounted on one side of said traversing plane, yarn lifting and catching means for selectively lifting the advancing yarn from said traversing plane in a direction away from said yarn cutting blade, then capturing and retaining the lifted advancing yarn in a laterally fixed position which is aligned with said yarn cutting blade when viewed in a direction perpendicular to said traversing plane, and then moving the advancing yarn in a direction opposite the lifting direction and into contact with said yarn cutting blade so as to sever the advancing yarn.

2. The yarn winding apparatus as defined in claim 1 wherein said yarn lifting and catching means comprises a laterally directed slide rod which includes two laterally directed arms which are inclined with respect to each other so as to have the configuration of a shallow V, and a yarn catch joined between said arms at a medial location along the length of said slide rod.

3. The yarn winding apparatus as defined in claim 2 wherein said yarn lifting and catching means further comprises actuation means for selectively moving said slide rod between an idle position on said one side of said traversing plane and a lifted position on the other side of said traversing plane.

4. The yarn winding apparatus as defined in claim 3 wherein said yarn traverse guide includes an upwardly open yarn receiving slot, and such that the yarn is lifted from said slot so as to separate the yarn from said reciprocating yarn traverse guide when said slide rod is moved to said lifted position.

5. The yarn winding apparatus as defined in claim 3 further comprising suction means including an opening adjacent said yarn cutting blade for withdrawing the severed end of the advancing yarn to waste receptacle.

6. A yarn winding apparatus, comprising means for rotatably mounting a tubular yarn bobbin for rotation about a laterally directed rotational axis, drive means for rotating said bobbin about said rotational axis, means for advancing a yarn to the bobbin so as to be wound thereupon and including yarn traversing means for laterally traversing the advancing yarn so as to form a cross wound package on the bobbin, and such that the traversing yarn defines a traversing plane, a yarn cutting blade mounted on one side of said traversing plane, a yarn lifting member mounted for movement between an idle position on said one side of said traversing plane and a lifted position on the other side of said traversing plane and so that the advancing yarn is engaged as the yarn lifting member moves from its idle position to its lifted position and is lifted from the traversing plane, actuation means for selectively moving said yarn lifting member between said idle and lifted positions, and yarn catch means mounted on said yarn lifting member for capturing and retaining the lifted advancing yarn in a laterally fixed position which is aligned with said yarn cutting blade when viewed in a direction perpendicular to said traversing plane, and such that upon movement of said yarn lifting member from said lifted position to said idle position the advancing yarn is brought into contact with said yarn cutting blade and severed.

7. The yarn winding apparatus as defined in claim 6 wherein said yarn traversing means comprises a laterally reciprocating yarn traverse guide positioned adjacent said bobbin mounting means, said yarn traverse guide having an upwardly open yarn engaging slot so that the advancing yarn is lifted from said yarn traverse guide when said yarn lifting member is moved to its lifted position.

8. The yarn winding apparatus as defined in claim 7 wherein said yarn traversing means further comprises a fixed yarn guide mounted upstream of said reciprocating yarn traverse guide so that the advancing yarn defines a traversing triangle which lies in said traversing plane.

9. The yarn winding apparatus as defined in claim 8 wherein said yarn lifting member is positioned between said reciprocating yarn traverse guide and said fixed yarn guide and comprises two parallel mounting legs, with each mounting leg having an inner end and an outer end, and with the inner end of each mounting leg being mounted for pivotal movement about a pivotal axis which is parallel to said rotational axis, and such that said mounting legs extend radially from said pivotal axis, and a slide rod extending laterally between said outer ends of said mounting legs.

10. The yarn winding apparatus as defined in claim 9 wherein said slide rod of said lifting member comprises two laterally directed arms which are inclined with respect to each other so as to have the configuration of a shallow V, and said yarn catch means is mounted between said arms at a medial location along the length of said slide rod.

11. The yarn winding apparatus as defined in claim 10 wherein said yarn catch means is in the form of a U having two laterally spaced ends, and with said ends being joined to respective ones of said arms.

12. The yarn winding apparatus as defined in claim 11 wherein said yarn catch means further comprises an extension which extends laterally across a portion of the width of said U from one of said ends thereof.

13. The yarn winding apparatus as defined in claim 10 wherein said yarn catch means comprises a helical loop of rod like material and which is joined between said arms.

14. The yarn winding apparatus as defined in claim 7 further comprising suction means including an opening adjacent said yarn cutting blade for withdrawing the severed end of the advancing yarn to a waste receptacle.

* * * * *